US008217752B2

(12) United States Patent
Kwon et al.

(10) Patent No.: US 8,217,752 B2
(45) Date of Patent: Jul. 10, 2012

(54) REMOTE MONITORING SYSTEM AND METHOD CONTROLLING THE SAME

(75) Inventors: Yong Hoan Kwon, Busan (KR); Kyoo Cheol Choi, Changwon-Si (KR); Hoon Bong Lee, Changwon-si (KR); Yong Tae Kim, Gimhae-si (KR)

(73) Assignee: LG Electronics Inc., Seoul (KR)

( * ) Notice: Subject to any disclaimer, the term of this patent is extended or adjusted under 35 U.S.C. 154(b) by 826 days.

(21) Appl. No.: 10/592,871

(22) PCT Filed: Jan. 23, 2006

(86) PCT No.: PCT/KR2006/000250

§ 371 (c)(1),
(2), (4) Date: Feb. 6, 2009

(87) PCT Pub. No.: WO2006/080792

PCT Pub. Date: Aug. 3, 2006

(65) Prior Publication Data

US 2009/0210198 A1 Aug. 20, 2009

(30) Foreign Application Priority Data

Jan. 25, 2005 (KR) ..... 10-2005-0006625
Mar. 19, 2005 (KR) ..... 10-2005-0022950

(51) Int. Cl.
*G05B 23/02* (2006.01)

(52) U.S. Cl. ..... 340/3.1; 340/3.7; 340/3.9

(58) Field of Classification Search ..... None
See application file for complete search history.

(56) References Cited

U.S. PATENT DOCUMENTS

| | | | | |
|---|---|---|---|---|
| 5,412,291 | A | 5/1995 | Payne et al. | 318/102 |
| 5,424,940 | A | 6/1995 | Ousborne | 364/140 |
| 5,774,528 | A * | 6/1998 | Bogner et al. | 379/106.01 |
| 5,799,281 | A * | 8/1998 | Login et al. | 705/1.1 |
| 5,839,097 | A * | 11/1998 | Klausner | 340/12.3 |
| 6,061,668 | A * | 5/2000 | Sharrow | 705/400 |
| 6,587,739 | B1 * | 7/2003 | Abrams et al. | 700/83 |
| 7,096,601 | B2 * | 8/2006 | Lyu et al. | 34/595 |
| 7,574,269 | B2 * | 8/2009 | Cenedese et al. | 700/17 |
| 7,621,012 | B2 * | 11/2009 | Kim | 8/147 |

(Continued)

FOREIGN PATENT DOCUMENTS

DE 196 15 840 A1 10/1997

(Continued)

OTHER PUBLICATIONS

International Search Report and Written Opinion.

(Continued)

*Primary Examiner* — Daniel Wu
*Assistant Examiner* — Emily C Terrell
(74) *Attorney, Agent, or Firm* — KED & Associates LLP

(57) ABSTRACT

The present invention relates to a remote monitoring system and a method controlling the same, which can selectively monitor according to a condition of power and a control of devices including a washer and a dryer installed in a remote place. The remote monitoring system comprises a communication module provided in each device for transmitting monitoring information after identifying an operation condition of each device according to a user's demand; and a remote monitoring unit for selecting a device to be monitored based on a result after identifying a power condition of each device, as well as displaying an operation condition of each device based on the transmitted monitoring information and the control of each device.

1 Claim, 7 Drawing Sheets

U.S. PATENT DOCUMENTS

| | | | | |
|---|---|---|---|---|
| 2002/0073183 | A1* | 6/2002 | Yoon et al. | 709/220 |
| 2003/0105567 | A1* | 6/2003 | Koenig et al. | 701/36 |
| 2003/0176928 | A1* | 9/2003 | Lee et al. | 700/11 |
| 2004/0139183 | A1 | 7/2004 | Motoyama et al. | 709/223 |
| 2005/0140506 | A1* | 6/2005 | Oh et al. | 340/538 |
| 2007/0247134 | A1* | 10/2007 | Ryan et al. | 323/318 |
| 2008/0053163 | A1* | 3/2008 | Park et al. | 68/13 R |

FOREIGN PATENT DOCUMENTS

| | | | |
|---|---|---|---|
| DE | 198 49 195 | A1 | 4/2000 |
| GB | 2265158 | A * | 9/1993 |
| KR | 10-2001-0113346 | A | 12/2001 |
| KR | 10-2003-0003947 | A | 1/2003 |
| KR | 10-2004-0045755 | A | 6/2004 |

OTHER PUBLICATIONS

German Office Action dated Nov. 27, 2008.

Korean Notice of Allowance dated Sep. 1, 2008 issued in Application No. 10-2005-0006625 (with translation).

Korean Office Action dated Jul. 25, 2011 issued in Application No. 10-2005-0022950.

* cited by examiner

[Fig. 1]
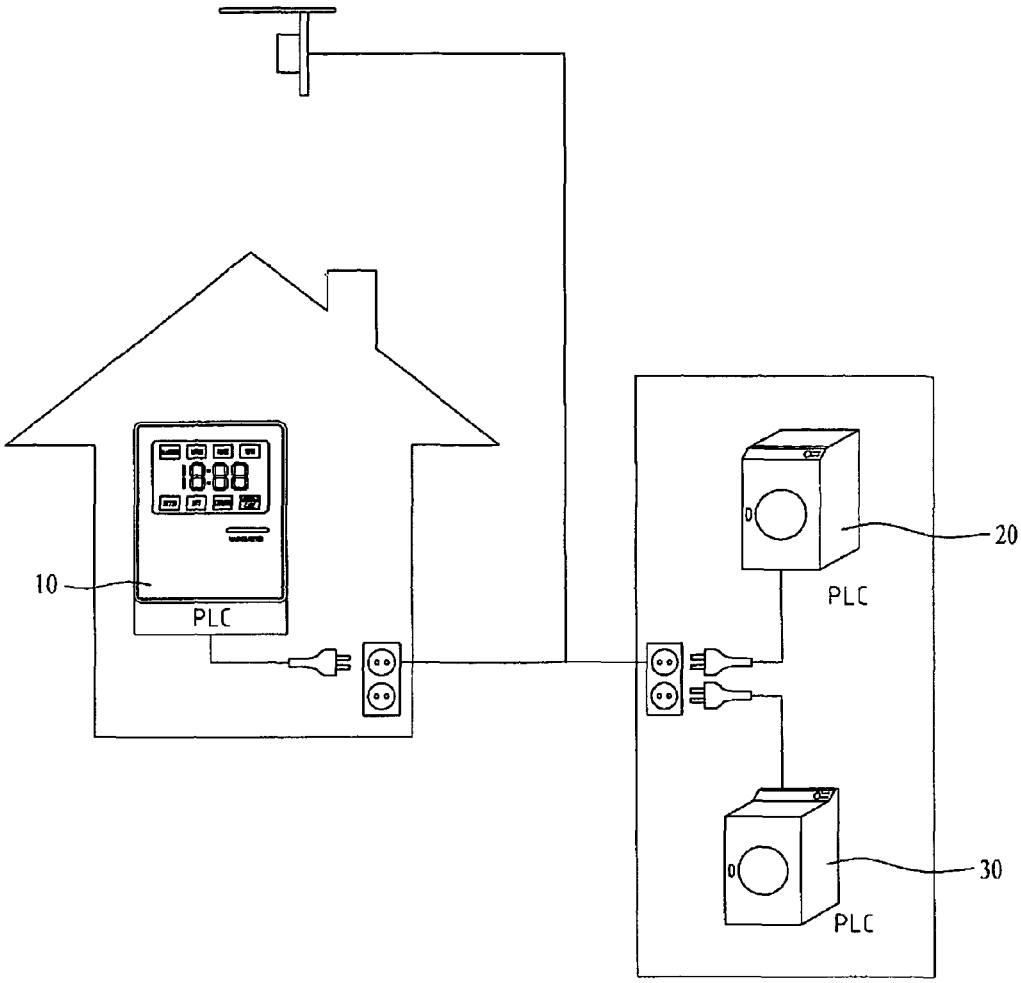

[Fig. 2]
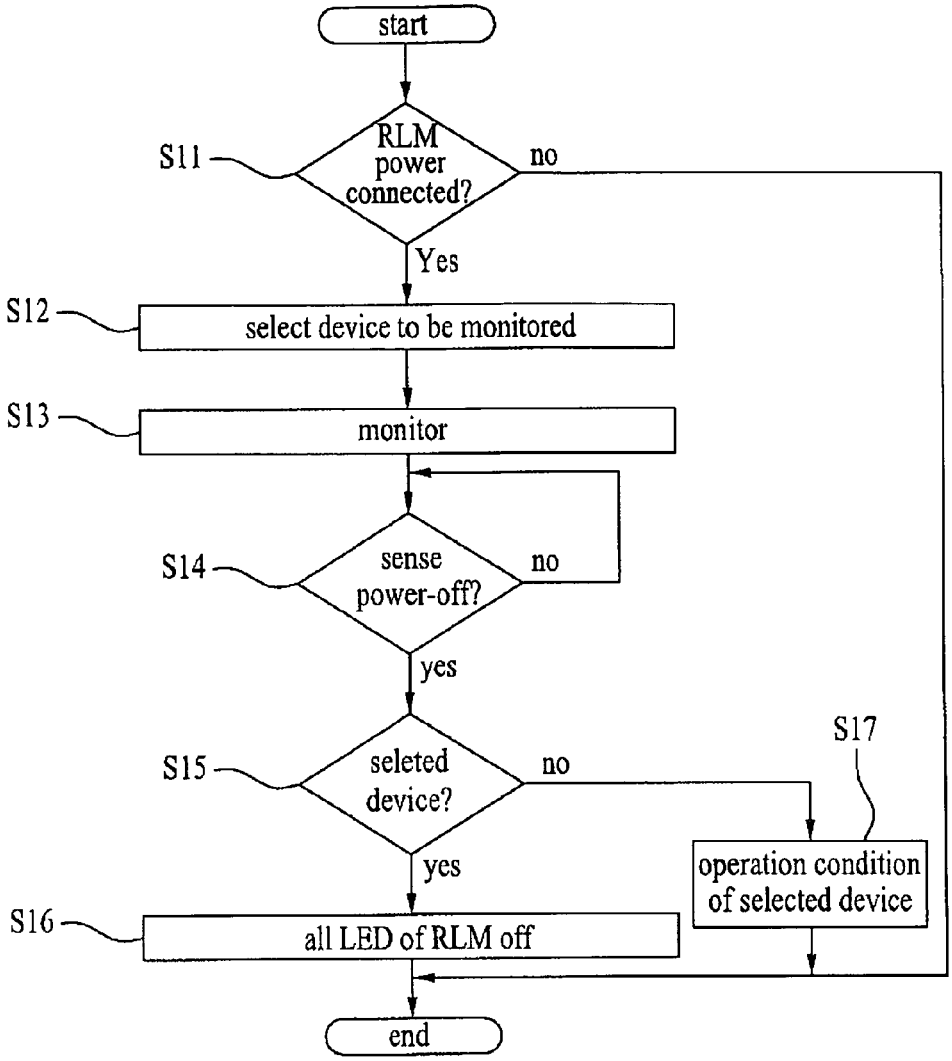

[Fig. 3]
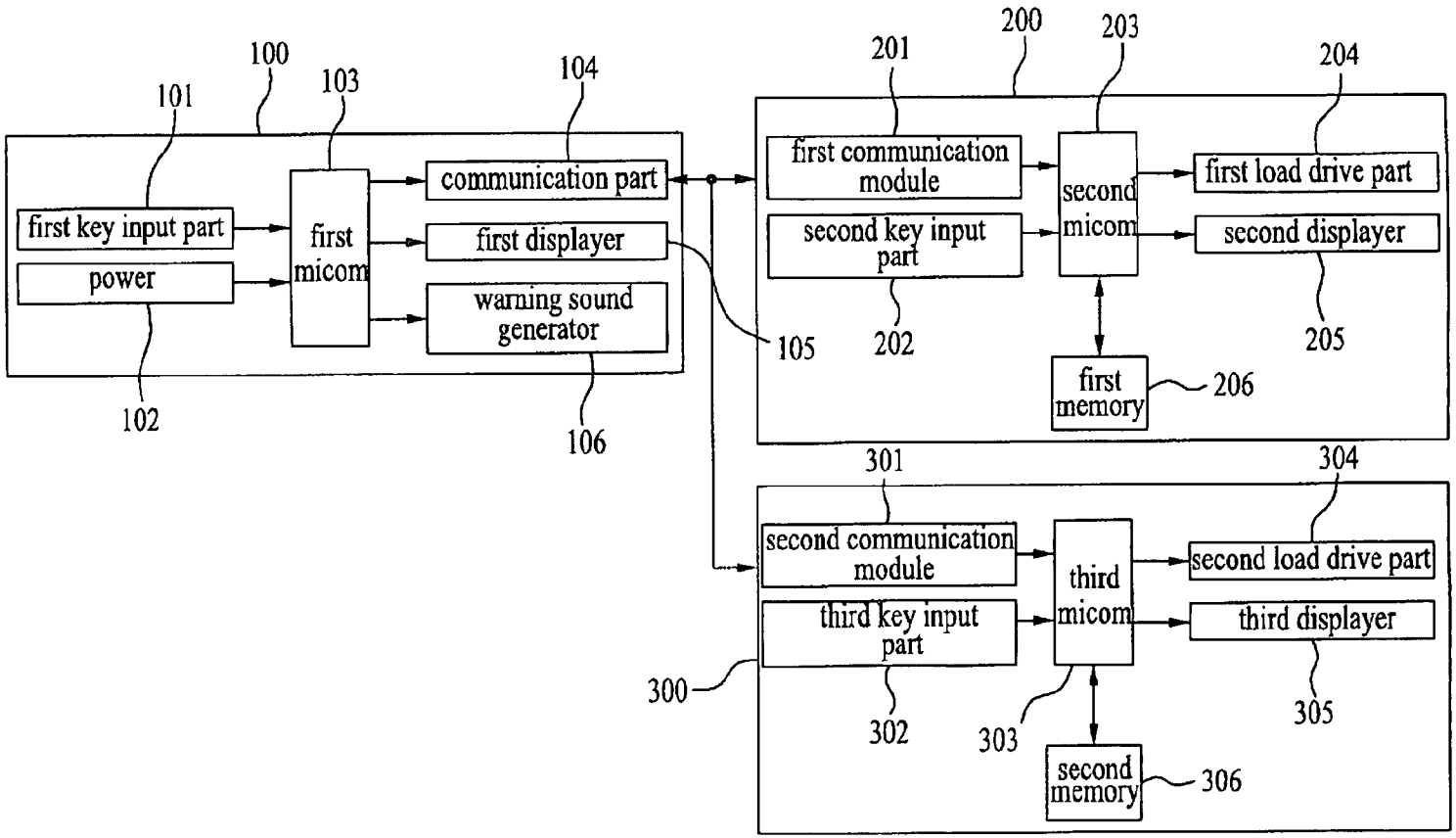

[Fig. 4]
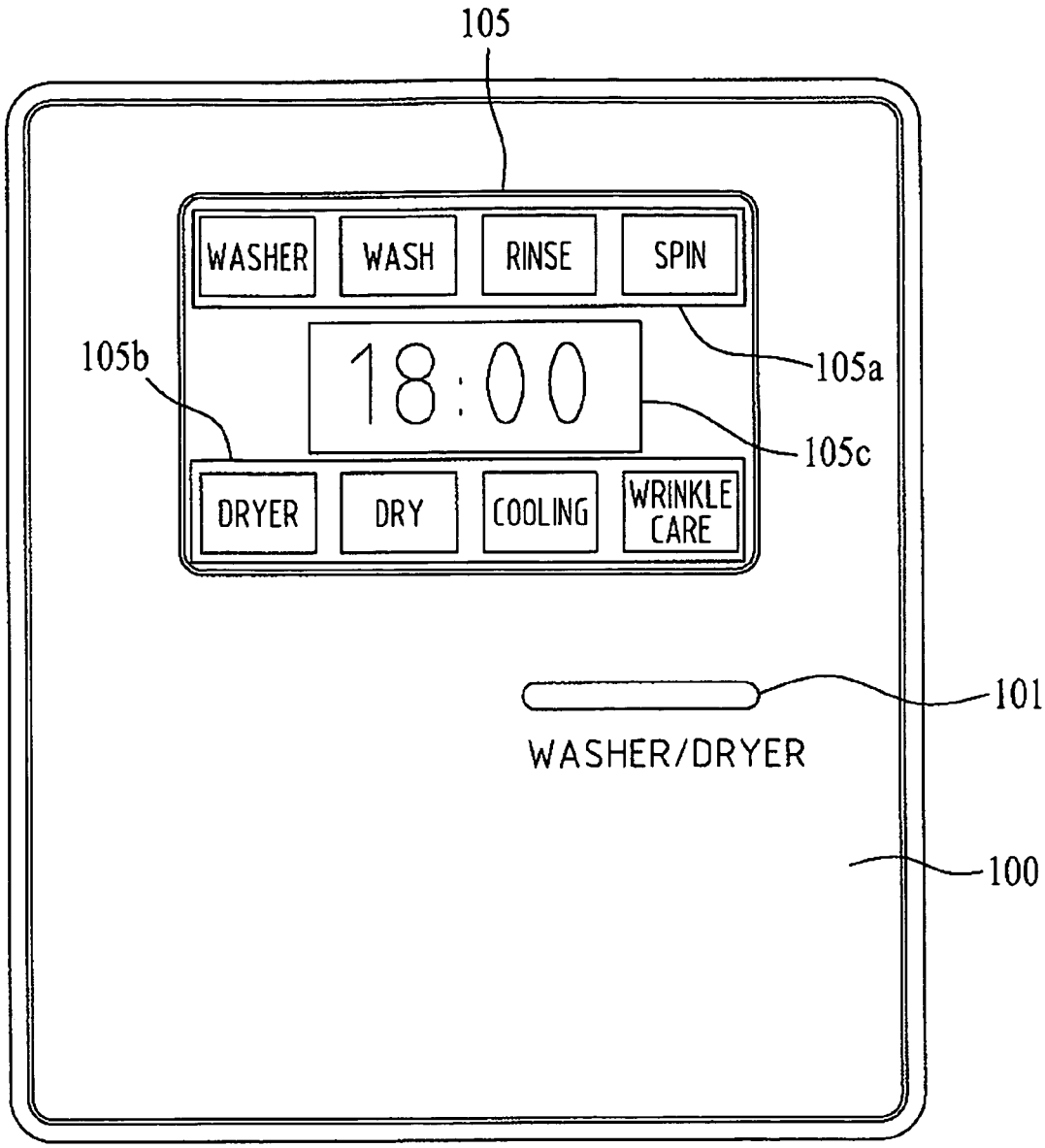

[Fig. 5]
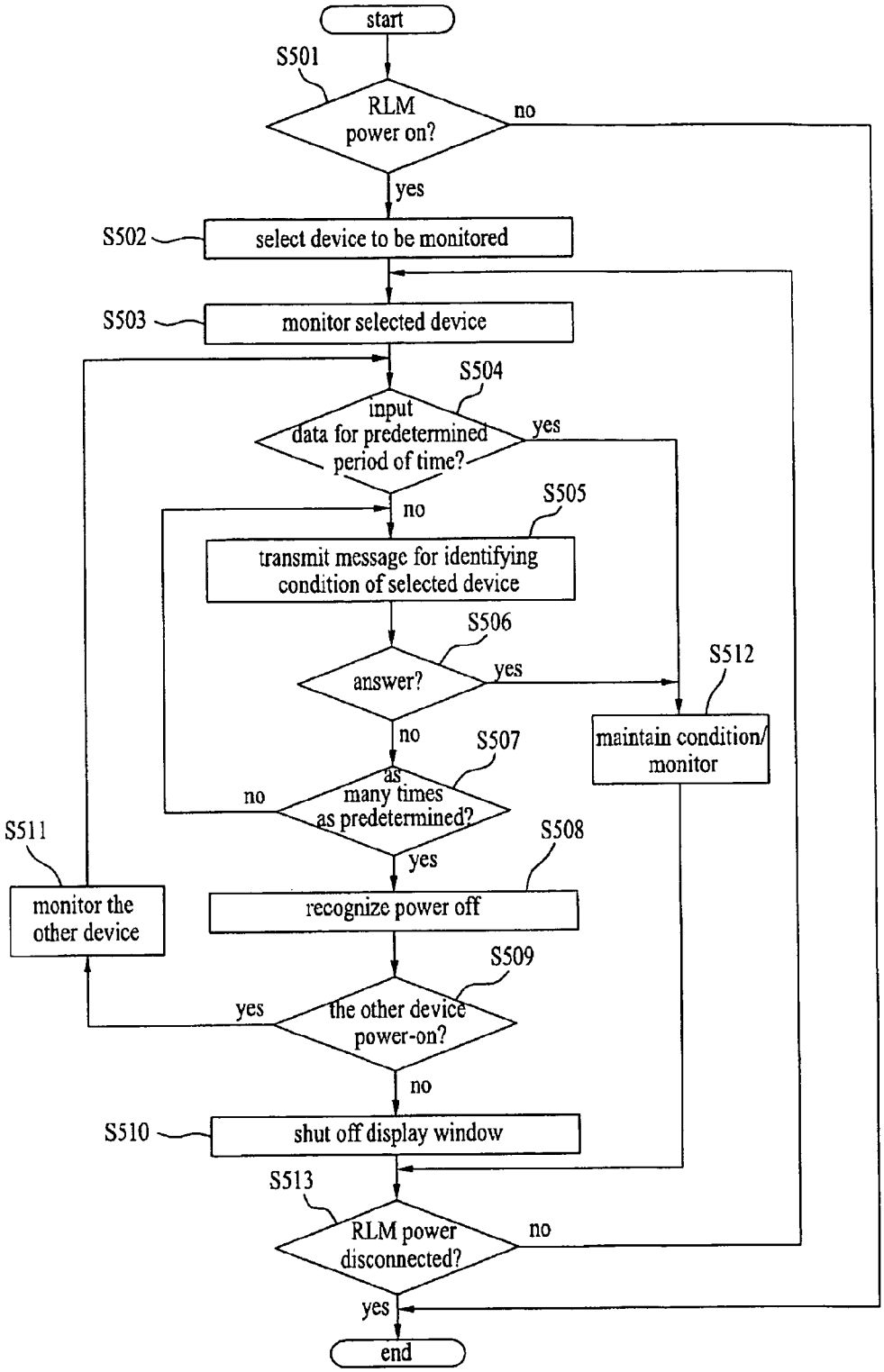

[Fig. 6]
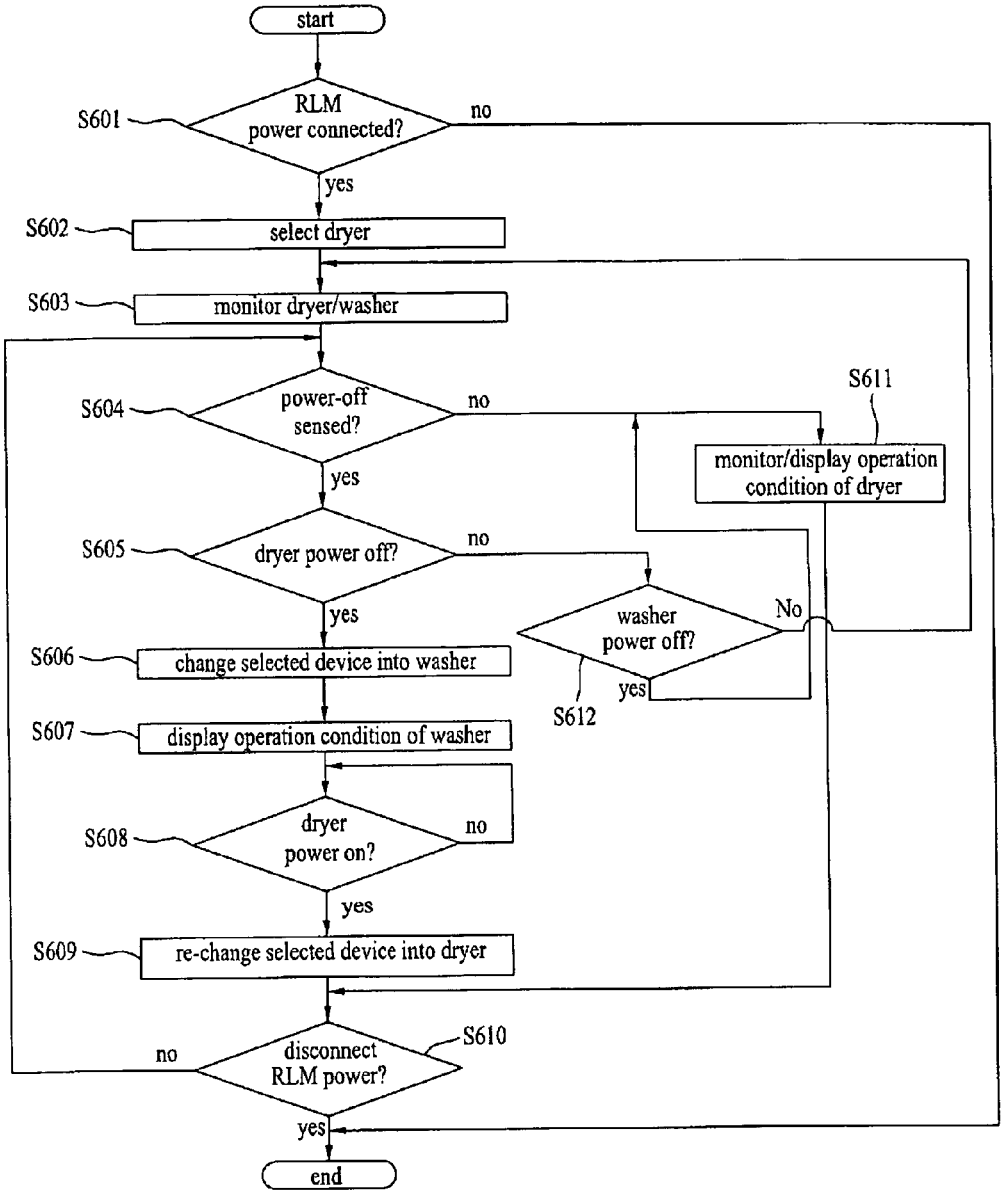

[Fig. 7]
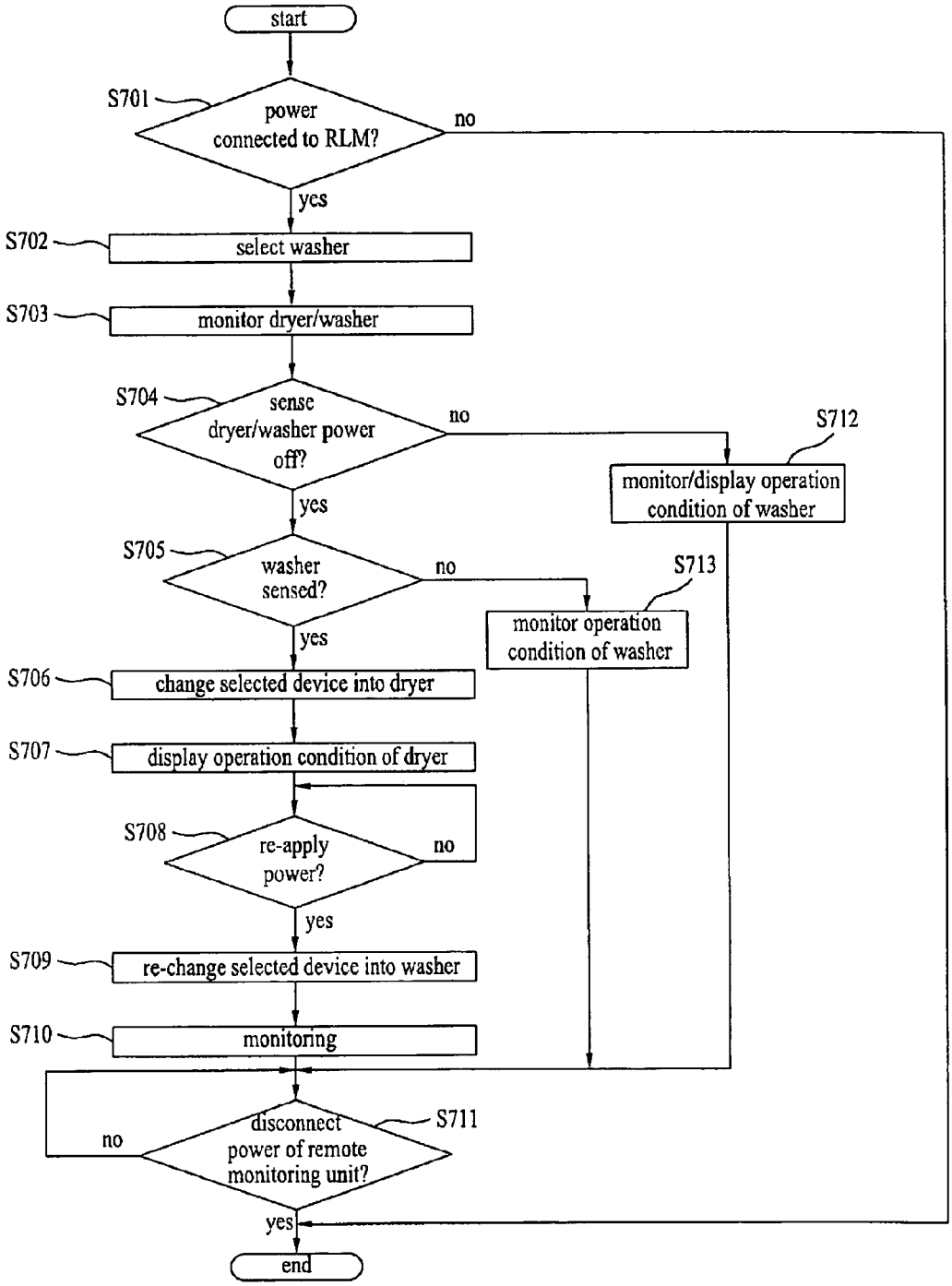

REMOTE MONITORING SYSTEM AND METHOD CONTROLLING THE SAME

This application claims priority to PCT/KR2006/000250, filed Jan. 23, 2006, published on Aug. 3, 2006, Publication No. WO 2006/080792 A1 in the English language and claims priority to Korean Application Nos. 10-2005-0006625, filed Jan. 25, 2005 and 10-2005-0022950, filed Mar. 19, 2005. The entire disclosure of the prior applications is considered as being part of the disclosure of the accompanying application and is hereby incorporated by reference therein.

TECHNICAL FIELD

The present invention relates to a monitoring system, and more particularly, to a remote monitoring system and a method controlling the same, which can selectively monitor according to a condition of power and a control of devices including a washer and a dryer installed in a remote place.

BACKGROUND ART

In general, a washer is an appliance which performs washing through a washing, rinsing, and spinning cycle, once a user introduces dirty laundry into a tub and then detergent and washing water are mixedly supplied.

Also, a dryer is an appliance which dries the laundry by absorbing moisture from the laundry once a heater generates steam and the steam is supplied into a drum.

However, those related art washers and dryers are usually installed in distant places such as outside storehouses and basement laundry rooms in Europe, and South America or North America, whereas they are usually installed inside here in Korea.

That is why people there have tendencies to enjoy keeping their lives in houses having much space, unlike Korean people having tendencies to enjoy their lives in apartments.

Recently, studies are under development, which enables remote controlling by connecting home appliances with an internet for a user to do his/her household chores free from time and space restriction.

Especially, there have been under development application to home appliances such as washer and dryers, which takes relatively longer time to perform one process. However, considering that a conventional washer has a function automatically shutting off power when predetermined time passes while not performing any cycles, it can be said that remote controlling is not performed when the power of the washing machine is off.

In case of performing remote controlling and monitoring through the internet, there are some problems that a PC capable of monitoring should be on and that a home network should be built.

Furthermore, in case that a washer and a dryer are installed in a distant place such as a outside storehouse and a basement laundry room, there are difficulties in creating the network place and also there are inconveniences that the user should frequently visit the place to check out the devices after he/she carries the laundry to the distant place to load the laundry and input an operation instruction.

Still further, since errors during the operation cannot be noticed, the user cannot be informed that the operations such as a washing cycle or a drying cycle is stopped due to the errors, only to maintain that state.

Still further, since it is possible to input an instruction of an operation only in the distant place having a washer and a dryer, an inconvenience may be caused to the user.

Thus, to solve those inconveniences, a washer 20 and a dryer 30 are installed outside and a monitoring unit 10 is inside as shown in FIG. 1.

Referring to FIG. 2, a method controlling a remote laundry monitor (hereinafter, RLM) according to the related art will be described.

First, it judged if the power of the RLM is connected (S11).

Next, Based on the result of the judgment (S11), once the power of the RLM is on, monitoring is performed after selecting a device to be monitored (S12-S13).

Hence, it is judged if a power-off is sensed while monitoring (S14).

It is also judged if the device having the power thereof sensed off is the one the user selected (S15).

Hence, in case that the device is the one selected by the user, a luminescent diode (hereinafter, LED) of a displayer in the RLM is off (S16).

Whereas, in case that the device is not the one selected by the user, being-off is not displayed, but an operation condition is displayed continuously (S17).

DISCLOSURE OF INVENTION

Technical Problem

The related art remote monitoring system displays a present condition of a device by means of data received through the RLM 10. However, the related art remote monitoring system has a problem of a frequent failure in identifying a present condition, because there is not data in case of disconnecting a power cord of the washer 20 or the dryer 30 during the operation, only to display the previous data without any changes.

Furthermore, the related art monitoring system has another problem that a LED of a displayer is off in case of the user's selecting a device which is turned off, because it displays through a monitoring unit only an operation condition of a device selected by the user.

Thus, it causes the user an inconvenience that he/she should select both of the devices for checking if the device is off or not.

Technical Solution

Accordingly, the present invention is directed to a remote monitoring system and a method controlling the same that substantially obviates one or more problems due to limitations and disadvantages of the related art.

An object of the present invention is to provide a remote monitoring system and a method controlling the same which can selectively monitor devices including a washer and a dryer according to a condition of power and a control of the washer and the dryer installed in a remote place.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a remote monitoring system for monitoring operation conditions of devices including a washer and a dryer comprising: a communication module provided in each device for transmitting monitoring information after identifying an operation condition of each device according to a user's demand; and a remote monitoring unit for selecting a device to be monitored based on a result after identifying a power condition of each device, as well as displaying an operation condition of each device based on the transmitted monitoring information and the control of each device.

At that time, the remote monitoring unit identifies if a power cord of each device is connected.

The power of the remote monitoring unit is automatically off, once the remote monitoring unit judges that all power cords of the washer and the dryer are disconnected.

In case a power cord of a device selected by a user is judged to be disconnected, the remote monitoring unit shuts off power or monitors an operation condition of the other device based on a result after identifying if the power cord of the other device connected.

The remote monitoring unit identifies if a power switch of each device is on or off.

In case it is judged that power of a device selected by the user is off, the remote monitoring unit monitors an operation condition of the other device based on the result after identifying if the power of the other device is on.

The remote monitoring unit comprising a first key input part for selecting a device between the washer and the dryer to be monitored, a communication part for communicating with the communication module each provided in the washer and the dryer, a first micom for outputting a control command based on a result of communicating with the communication module as well as controlling the operation conditions of the washer and the dryer to be selectively displayed after identifying if power of a device selected by the user is on or off, and a first displayer for displaying the operation conditions of the washer and the dryer based on a control signal of the first micom.

In another aspect of the present invention, a method controlling the remote monitoring system having a remote monitoring unit for remote monitoring operation conditions of a washer and a dryer comprising steps of: selecting a device between the washer and the dryer to be monitored; judging if power cords of the washer and the dryer are connected; and controlling a displayer of the remote monitoring unit to be power-on or power-off based on the condition if the power cord of the device selected by a user is connected or not.

The step of judging if power cords of the washer and the dryer are connected comprises a step of the remote monitoring unit's transmitting a message identifying an operation condition to the dryer as many times as predetermined, followed by judging if the power cord of the dryer is connected based on the result after identifying if there are as many answers transmitted from the washer, once the selected device is the dryer.

The step of judging if power cords of the washer and the dryer are connected further comprises a step of the remote monitoring part's transmitting a message identifying an operation condition to the washer as many times as predetermined, followed by judging if the power cord of the washer is connected based on a result after there are as many answers transmitted from the washer, once the selected device is the washer.

The step of controlling a displayer of the remote monitoring unit to be power-on or power-off based on the condition if the power cord of the device selected by the user is connected or not comprises steps of identifying if the power cord of the washer is connected, once a device selected by the user is the dryer and the power cord of the dryer is sensed to be disconnected, remote monitoring the operation condition of the washer, once the power cord of the washer is identified to be connected, and shutting off the power of the displayer, once the power cord of the washer is identified to be disconnected.

The step of controlling a displayer of the remote monitoring unit to be power-on or power-off based on the condition if the power cord of the device selected by the user is connected or not comprises steps of identifying if the power cord of the dryer is connected, once a device selected by the user is the washer and the power cord of the washer is sensed to be disconnected, remote monitoring the operation condition of the dryer, once the power cord of the dryer is identified to be connected, and shutting off the power of the displayer, once the power cord of the dryer is identified to be disconnected.

In another aspect of the present invention, a method controlling the remote monitoring system having a remote monitoring unit for monitoring operation conditions of a washer and a dryer comprises steps of: selecting a device to be monitored between the washer and the dryer; sensing if the washer and the dryer are power-on or power-off; and selecting a device to be monitored based the power-on/off condition of the device selected by the user.

The step of selecting a device to be monitored based the power-on/off condition of the device selected by a user comprises a step of monitoring an operation condition of a washer after changing the device selected in the remote monitoring unit into the washer until power is applied to a dryer, once the selected device is a dryer and the power of the dryer is sensed to be off.

The device selected in the remote monitoring unit is re-changed into a dryer to be monitored, once the power of the dryer initially selected by the user is on in the middle of monitoring the operation condition of the washer after changing the selected device into the washer.

The step of selecting a device to be monitored based the power-on/off condition of the device selected by a user comprises a step of monitoring an operation condition of a dryer after changing the device selected in the remote monitoring unit into the dryer until power is applied to a washer, once the selected device is a washer and the power of the washer is sensed to be off.

The device selected in the remote monitoring unit is re-changed into a washer to be monitored, once the power of the washer initially selected by a user is on in the middle of monitoring the operation condition of the dryer after changing the selected device into the dryer.

It is to be understood that both the foregoing general description and the following detailed description of the present invention are exemplary and explanatory and are intended to provide further explanation of the invention as claimed.

Advantageous Effects

As described above, the remote monitoring system and the method controlling the same has following industrial advantageous effects.

First, unnecessary power consumption can be prevented, because power is selectively applied to the displayer of the remote monitoring unit by means of judging if the power cord of a device selected by a user is connected.

Second, the user can recognize conditions of power cord connection of a device he/she has selected.

Third, in case the power cord of a device is on again, it can be identified if the device is operated or not.

Fourth, in case a user selects a device sensed to be power-off, the device to be monitored can be automatically changed into the other device put into operation.

Fifth, it is more convenient to a user, because monitoring is selectively possible without additional key input parts, even though power-off is sensed.

Sixth, unnecessary monitoring can be prevented, because monitoring is selectively performed based on conditions of power on/off.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 1 diagram illustrating a related art remote monitoring system.

FIG. 2 is a flow chart illustrating a method controlling the related art remote monitoring system.

FIG. 3 is a block view illustrating a structure of a remote monitoring system according to the present invention.

FIG. 4 is a front view illustrating a remote monitoring unit shown in FIG. 3.

FIG. 5 is a flow chart illustrating a first embodiment of the remote monitoring system according to the present invention.

FIG. 6 is a flow chart illustrating a second embodiment of the remote monitoring system according to the present invention.

FIG. 7 is a flow chart illustrating a third embodiment of the remote monitoring system according to the present invention.

MODE FOR THE INVENTION

Reference will now be made in detail to the preferred embodiments of the present invention, examples of which are illustrated in the accompanying drawings. Wherever possible, the same reference numbers will be used throughout the drawings to refer to the same or like parts.

FIG. 3 is a block view illustrating a structure of a remote monitoring system according to the present invention. FIG. 4 is a front view illustrating a first displayer of a remote monitoring unit shown in FIG. 3. FIG. 5 is a flow chart illustrating a first embodiment of the remote monitoring system according to the present invention. FIG. 6 is a flow chart illustrating a second embodiment of the remote monitoring system according to the present invention.

As shown in FIG. 3, a remote monitoring system according to the present invention includes a washer 200 and dryer 300 installed in a distant place, not in a house, and a remote monitoring unit 100 for controlling the washer 200 and dryer 300 as well as monitoring operation conditions of the washer 200 and dryer 300.

The remote monitoring unit 100 includes a first key input part 101 for selecting one device between the washer 200 or the dryer 300 which a user wants to monitor, a power 102 for supplying power, a first communication part 104 for communicating with the washer 200 and the dryer 300, a first micom 103, a first displayer 105 and a warning sound generator 106. The first micom 103 controls to monitor the operation condition of the washer 200 and the dryer through the first communication part 104 based on a user's command inputted through the first key input part 101, and makes monitoring changeable according to a condition of a device selected by the user. The first displayer 105 not only displays an operation condition of the washer 200 and the dryer 300 based on control signals of the first micom 103, but also displays a completed cycle. The warning sound generator 106 let errors of the washer 200 and the dryer 300 noticed based on control signals of the first micom 103.

At that time, power is controlled after being divided into a power cord condition and an on/off condition. That is, before being controlled, there are a condition in which a power cord is plugged off by the user and a condition in which the power is temporarily off due to an operation of a device.

As shown in FIG. 4, the remote monitoring unit 100 includes a displayer 105 for displaying each condition of washer 200 and the dryer 300, and a key input part 101 for selecting a device which the user wants between the washer 200 and the dryer 300.

Then, the displayer 105 includes a first display window 105*a* for displaying conditions of the washer 200, a second display window 105*b* for displaying operation conditions and a third display window 105*c* for displaying an operation time period and etc.

The washer 200 includes a first communication module 201, a second key input part 202, a second micom 203, a first load drive part 204, a second displayer 205 and a first memory 206. The first communication module 201 is for communicating with the communication part 104 of the remote monitoring unit 100, and the second key input part 201 is for inputting the user's commands. The first load drive part 204 drives load based on control signals of the second micom 203, and the second display part 205 displays an operation condition of the washer 200 based on control signals of the second micom 203, and also, the first memory 206 memorizes various kinds of menus related to the operation.

The dryer 300 includes a second communication module 301, a third key input part 302, a third micom 303, a second load drive part 304, a third displayer 305 and a second memory 306. The second communication module 301 communicates with the communication part 104 of the remote monitoring unit 100, and the third key part 302 is for inputting the user's command. The third micom 303 outputs control signals to control the dryer 300 based on the user's command as well as controlling to transmit operation conditions to the remote monitoring unit 100 based on the monitoring commands inputted through the second communication module 301. A second load drive part 304 drives load based on control signals of the third micom 303, and the third displayer 305 displays operation conditions based on control signals of the third micom 303, and the second memory 306 is for memorizing various menus relating to the operation of the dryer 300.

At that time, the communication part 104, and the first and second communication module 201 and 301 are communicating through power line communication, wire communication or wireless communication.

The remote monitoring system according to the present invention may directly communicate with the remote monitoring unit 100, the washer 200 and the dryer 300, not even through an auxiliary network such as a gate way or a communication network such as an internet.

That is, the remote monitoring unit 100 not only displays but also monitors an operation condition of a device between the washer 200 and the dryer 300 through the first displayer 105, which is selected by the user through the first key input part 101.

At that time, the device selected by the user or the other device put into operation is monitored based on a power cord condition or power on/off condition of a device selected either of the washer 200 and the dryer 300.

For example, first, the power of the remote monitoring unit is automatically off once the power cord of the remote monitoring unit 100 is judged to be disconnected.

At that time, the power-off means shutting off the displayer of the remote monitoring unit 100.

Next, the remote monitoring unit 100 identifies if the power cord of a device selected by the user is connected so as to monitor an operation condition of the other device or to shut off the power of the remote monitoring unit 100.

Thus, the other device of which a power cord is connected may be remote monitored based on a condition if the power cord of the washer 200 or the dryer 300 is connected. Once neither of the power cord is connected, it means that the power is not applied to the first displayer 105.

For another example, the remote monitoring unit 100 identifies if power switches of all parts are on or off. Hence, once the power of the device selected by the user is judged to be off, the remote monitoring unit 100 identifies if the power of the other device is on or off, and monitors the other device based on the result.

A method controlling the remote monitoring system will be described as follows.

FIG. 5 is a flow chart illustrating a first embodiment of a method controlling the remote monitoring system according to the present invention.

The method controlling the remote monitoring system according to the first embodiment of the present invention is that a monitored device is selected or a display window of a device is off based on conditions of power cord connection.

First of all, it is judged if the power is connected to a RLM (S501).

Next, according to the result, once the power is connected to the RLM, a device the user wants to remote monitor is selected (S502).

Hence, the selected device is monitored (S503).

At that time, it is judged if data is inputted from the selected device for a predetermined period of time (S504).

According to the result, once there is no inputted data for the predetermined period of time, a message for demanding to identify a condition of the selected device is transmitted to the device by the remote monitoring unit (S505).

Hence, it is judged if there are as many answers as predetermined times from the selected device (S506-S507).

Accordingly, once a step of judging is performed as many times as predetermined and there are not as many answers, it is recognized that the power cord is not connected (S508).

Hence, after identifying if the power of the other device is on, a condition of power cord connection is identified for remote monitoring the other device, not the selected one (S509) (S511).

On the other hand, according to the result of the step (S509), in case the power of the other device is not on, the power of the first displayer 105 is off (S510).

It is judged if the power of the other device is on or off in a state of maintaining a power-off of the first displayer 105 until the power of the remote monitoring unit (S513).

Also, once data is inputted for the predetermined period of time or there are as many answers from the selected device as the result of the judgments (S504) (506), a remote monitoring is performed with maintaining the condition (S512).

As described above, the remote monitoring system and the method controlling the same according to the present invention is for selectively controlling the power on/off of the first displayer 105 in the remote monitoring unit 100 by means of identifying the power cord of the device selected by the user.

Also, once the power cord of the device selected by the user is judged to be disconnected, the condition of the power cord connection of the other device is judged and monitored. Thereby, efficiency of remote monitoring is enhanced.

A method controlling the remote monitoring system according to a second embodiment of present invention is that a monitored device is selected based on conditions of power switches and monitoring is controlled in case the selected device is a dryer.

FIG. 6 is a flow chart illustrating the second embodiment of the method controlling the remote monitoring system.

First, it is judged if power is connected to a RLM (S601).

Next, once the power is connected to the RLM based on the result of the step (S601), a user selects a dryer (S602).

Hence, the selected dryer is monitored (S603).

It is judged if the power of the dryer is off, together with monitoring the selected dryer (S604) (S605).

If the power of the dryer is on, that means the user selects to monitor the dryer. Thereby, the dryer is monitored normally (S611).

If the dryer is judged to be off, a device selected to be monitored is changed into a washer (S606).

Hence, an operation condition of the washing machine is monitored and displayed (S607).

While displaying the operation condition of the washer described above, it is judged if the power of the dryer initially selected by the user is on (S608).

In case the dryer is not on, the operation condition of the washer changed from the dryer are monitored and displayed (S609).

If the power of the washing machine is on, turn back to step 603 to monitor the selected dryer. Or, if the washing machine is judged to be off, turn back to step 611 if the power of the dryer is on to monitor the dryer.

In case the dryer is on again, the selected device is rechanged into the dryer, monitoring the dryer is performed (S609).

Hence, the power is disconnected from the remote monitoring unit to be finished (S610).

On the other hand, a method controlling the remote monitoring system according to the third embodiment of the present invention is that a monitored device is selected based on conditions of power switches, for a case that the selected device is a washer.

FIG. 7 is a flow chart illustrating a third embodiment of a method controlling the remote monitoring system according to the present invention.

First, it is judged if power is connected to a remote monitoring system (S701).

Once the power is judged to be connected to the remote monitoring system by the result, it means that a user selects a washer (S702).

Hence, the selected washer is monitored (S703).

It is judged if the power of the washer is off, with monitoring the selected washer (S704) (S705).

If the washer is power-on, it means the user selects to monitor the washer, so that the washer is monitored (S711).

Whereas, if the washer is judged power-off, a device selected to be remote monitored is changed into a dryer (S706).

Hence, an operation condition of the dryer is monitored and displayed (S707).

While displaying the operation condition of the dryer, it is continuously judged if the washer initially selected by the user is power-on (S708).

In case the washer is not power-on, the operation condition of the dryer is continuously monitored and displayed.

Then, in case the washer is power-on, the selected device is re-changed into the washer and the washer is monitored (S709).

Hence, the power of the remote monitoring unit is disconnected to be finished (S710).

If the power to the washer is not judged to be off in S704, the operation condition of the washer continues to be monitored and/or that condition continues to be displayed (S712). If the power to the washer is judged to be off in S704, an operation is performed to determine whether operation of the washer is detected, in S705. If operation of the washer is not detected, operation of the washer is monitored and/or that condition is displayed (S713).

INDUSTRIAL APPLICABILITY

According to the method controlling the remote monitoring system of the present invention, in case a user selects a device which is power-off, the other device, if there is one, is monitored.

The invention claimed is:

1. A method for controlling a remote monitoring unit, the method comprising:

selecting a device to be monitored, wherein the selected device corresponds to one of a washer or a dryer and wherein the other one of the washer or dryer corresponds to an unselected device;

judging if a power cord of the selected device is connected; and controlling a displayer of the remote monitoring unit to be powered-on or powered-off based on whether the power cord of the selected device is connected or not, wherein said judging comprises:

transmitting from the remote monitoring unit a message identifying an operation condition of the selected device, the message transmitted a first number of times, receiving a second number of answers from the selected device, determining whether the second number is equal to the first number, and judging that the power cord of the selected device is not connected when the second number does not equal the first number, and wherein, when the power cord of the selected device is judged to be disconnected, controlling the displayer of the remote monitoring unit to be powered-on or powered-off comprises:

identifying if the power cord of the unselected device is connected, remotely monitoring an operation condition of the unselected device when the power cord of the unselected device is identified as being connected, and shutting off power of the displayer when the power cord of the unselected device is identified to be disconnected.

* * * * *